US006575840B2

(12) United States Patent
Hagerty

(10) Patent No.: US 6,575,840 B2
(45) Date of Patent: Jun. 10, 2003

(54) POOL SLIDE

(76) Inventor: Michael J. Hagerty, 3050 S. Alvernon Way, Tucson, AZ (US) 85713

( * ) Notice: Subject to any disclaimer, the term of this patent is extended or adjusted under 35 U.S.C. 154(b) by 0 days.

(21) Appl. No.: 10/054,347

(22) Filed: Jan. 19, 2002

(65) Prior Publication Data

US 2002/0098895 A1 Jul. 25, 2002

Related U.S. Application Data

(60) Provisional application No. 60/263,614, filed on Jan. 23, 2001.

(51) Int. Cl.[7] ..... A63G 21/18
(52) U.S. Cl. ..... 472/117; 472/116
(58) Field of Search ..... 472/116, 117, 472/128, 136, 137; 182/48, 49; 104/69, 70; 482/35, 36

(56) References Cited

U.S. PATENT DOCUMENTS 1,774,045 A * 8/1930 Watkins ..... 472/116
2,841,396 A * 7/1958 Foss ..... 472/116
3,083,015 A * 3/1963 Barenholtz et al. ..... 182/49
3,385,599 A * 5/1968 Davis ..... 104/69
4,194,733 A 3/1980 Whitehouse
4,379,551 A * 4/1983 Ahrens ..... 472/116
4,394,173 A * 7/1983 Aste ..... 104/124
4,484,739 A * 11/1984 Kreinbihl et al. ..... 104/70
4,805,898 A 2/1989 Jacober et al.
4,811,943 A * 3/1989 Ahrens ..... 104/70
5,387,158 A * 2/1995 Bertrand ..... 472/106
5,407,393 A 4/1995 Schmidt
5,478,281 A 12/1995 Forton
5,865,679 A 2/1999 Seabolt et al.

* cited by examiner

*Primary Examiner*—Kien T. Nguyen
(74) *Attorney, Agent, or Firm*—Jennings, Strouss & Salmon PLC; Joseph W. Mott

(57) ABSTRACT

A backyard swimming pool slide includes a 90 degree runway curve, a banked runway rail to offset centrifugal force, and a high volume water diffuser source to enhance the ride. Also disclosed is an integrated ladder, platform and handrail assembly and a center stanchion for cantelever support at the exit end of the slide.

10 Claims, 3 Drawing Sheets

POOL SLIDE

This application is a continuation-in-part of provisional patent application No. 60/263,614, filed Jan. 23, 2001 now abandoned.

TECHNICAL FIELD

The present application relates to swimming pool slides.

BACKGROUND OF THE INVENTION

Swimming pool slides for recreation and amusement are well known and typically comprise a ladder, a platform at the top of the ladder, a runway down which the user slides, and an exit into a pool of water. To decrease friction, between the runway surface and the user, many slides include a source of water flowing from the top of the runway.

Recreational pool slides may be configured as large-scale slides for water parks or other public amusement locations. An Example is shown in U.S. Pat. No. 4,194,733 (Whitehouse). Pool slides may also be scaled for typical backyard use, either in a conventional in-ground swimming pool or a pool that sits above the ground. An example of the former is U.S. Pat. No. 5,478,281 (Forton), while U.S. Pat. No. 5,407,393 (Schmidt) and U.S. Pat. No. 4,805,898 (Jacober, et al.) are representative of the latter.

Various techniques have been developed to provide the desired friction-decreasing water flow from the top of the slide. In U.S. Pat. No. 5,865,679 (Seabolt, et al.) a tube across the top of the slide, where the platform meets the runway, has multiple sets of openings whereby water is sprayed onto the platform surface and also onto the user. Forton discloses a pair of opposing, slightly offset flow fittings set into the runway rails at the top of the slide so that jets of water blanket the entire runway surface. In Jacober, et al., a tube across the top of the slide, with water spray openings, is used.

Pool slides for in-ground background pools are generally adapted to mount on the pool deck. They may be straight slides, in which the ladder and runway are perpendicular to the side of the pool, or curved slides, in which the user starts at an angle to the pool side and is carried along a curved runway that exits perpendicular to the side of the pool. The height of the slide ladder may vary, starting from about three feet. Eight feet is generally the maximum ladder length for home pools, while substantially longer ladders, with higher platforms, are used in community or public recreation pools.

SUMMARY OF THE INVENTION

It is an object of the current invention to supply a compact but enjoyable pool slide primarily for backyard pool use. A short elevation, about three feet, enhances safety, particularly for children. A 90° runway curve, whereby the platform is aligned parallel to the side of the pool and the runway exit is perpendicular to the side of the pool, provides the user with a ride-enhancing centrifugal force in a compact space. The tight curvature over a short length also discourages a user from the dangerous practice of sliding headfirst. To lower the friction between user and runway, a high volume distribution of water across the runway is employed.

DETAILED DESCRIPTION OF THE INVENTION

Figure 1:
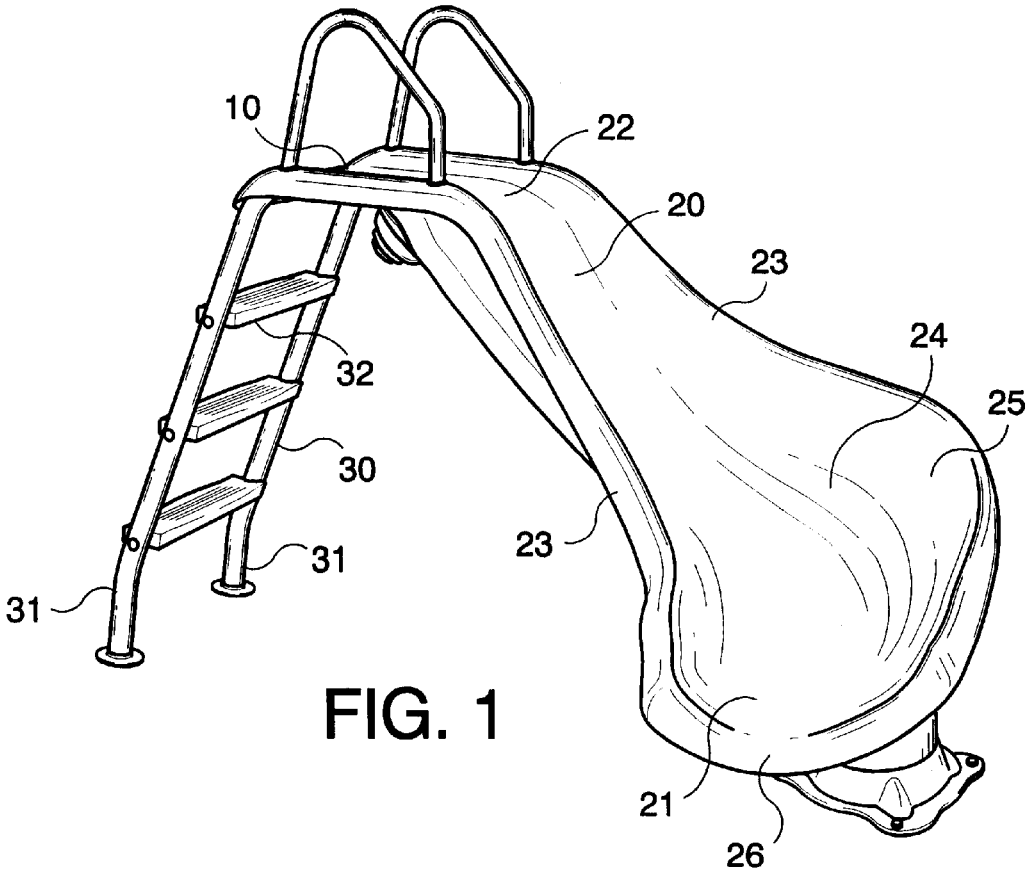
FIG. 1 is a side view of an embodiment of the pool slide invention.
Figure 2:
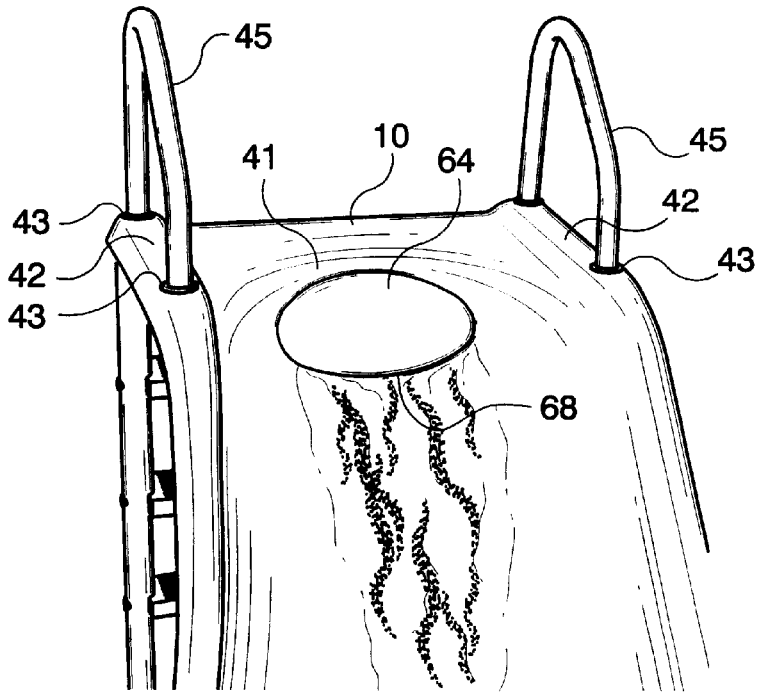
FIG. 2 is a top view of the slide of FIG. 1.

As may be seen in FIGS. 1 and 2, the slide is a compact, 90° curved slide with a low platform height. In this embodiment, platform 10 is positioned about 3 feet above the ground. Ladder 30 is oriented parallel to the edge of the pool. The runway 20 curves through 90° of arc, so that the runway exit 21 is approximately perpendicular to the runway entrance 22 adjoining platform 10. The curvature may either be right handed or left handed, depending on the desired positioning with respect to the pool.

The slide is fabricated of conventional recreational pool slide materials, such as reinforced fiberglass, acrylic and ABS laminate. For most of the length, the runway rails 23 are of conventional height to provide safe confinement of the user and an optional handhold. The outside runway rail 23 on the convex side of the curve, is substantially elevated at the region 24 of the maximum user velocity. This allows the user under centrifugal force to ride slightly up the wall 25, as in a banked turn, giving a toboggan-like ride and decreasing the likelihood of falling off the slide.

The exit lip 26 of the runway 20 may be slightly higher than the lower point of the slide. This gives the rider a slight upward impetus upon exiting the slide, causing the sensation of being launched outward over the pool rather than directly into the pool. Such a configuration, while not necessarily a good design for the headfirst slider, enhances the ride experience for the seated user.

Figure 3:
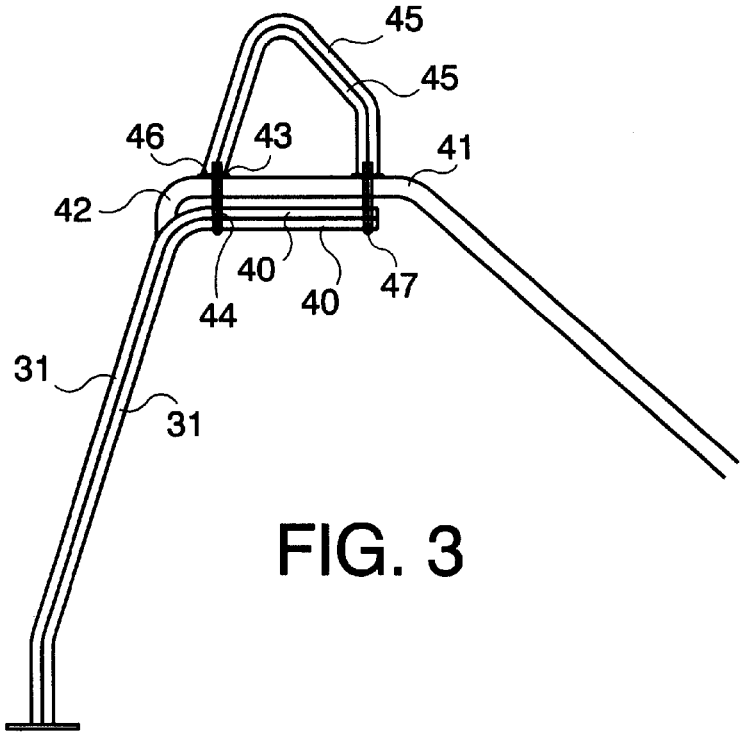
FIG. 3 is a side view of the ladder and platform of the pool slide in FIG. 1.

The slide of the present invention also includes an improved ladder and handrail configuration, as shown in FIG. 3. Ladder 30 is of a standard type, with a pair of rails 31 connected by a plurality of steps 32. The tubular ladder rails 31 are extended beyond the height of the ladder and are bent to form platform-supporting rails 40 that will be horizontal when the slide is assembled. The body of the slide includes platform 10, an integral runway portion 41 and platform sides 42. The platform sides 42 includes apertures 43 that align with apertures 44 in the platform-supporting rails 40. A pair of handrails 45 for mounting on either side of platform 10 also includes apertures 46 that align with apertures 43 in the platform. Bolts or other fastening means 47 are inserted through the apertures 43, 44 and 46 to integrally connect the ladder rails, slide body and handrails for a stable and safe structure.

Figure 4:
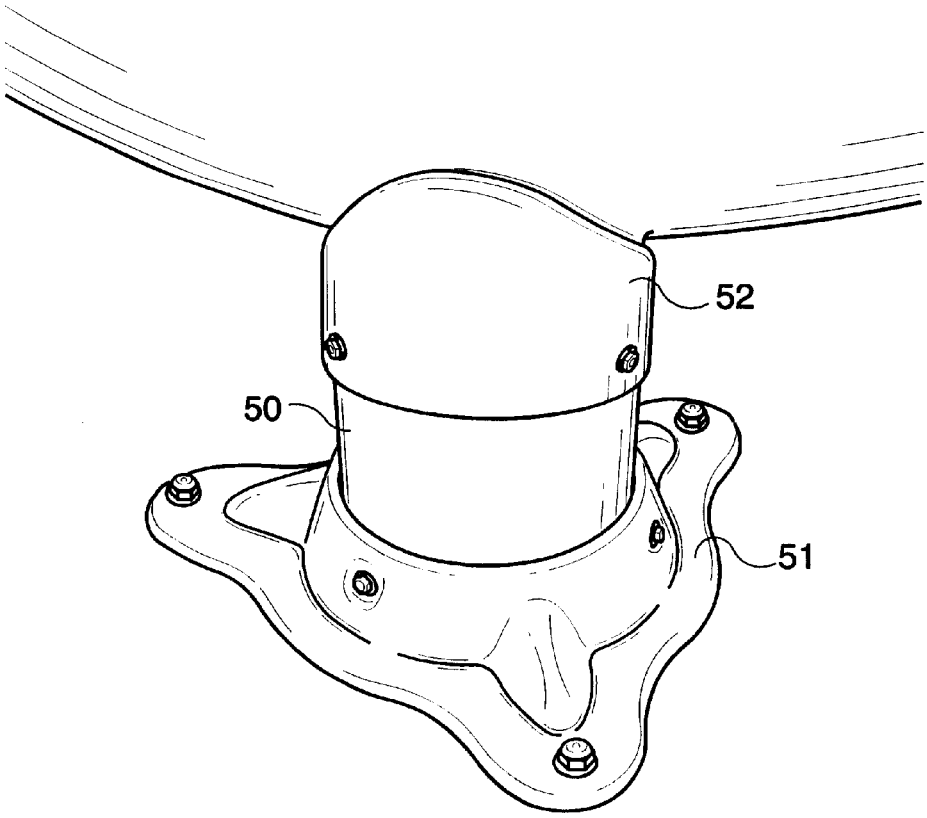
FIG. 4 is a view of the support stanchion for the slide of the current invention.

The lower end of the slide is supported by a center stanchion instead of the usual pair of tubular aluminum front legs. See FIG. 4. Stanchion 50 is a large diameter tube mounted to a base plate 51. The size, shape and material of the stanchion and base plate may be varied in accordance with the anticipated design load. In one embodiment, the stanchion is a 6 inch thick plastic tube inserted into a fiberglass base plate, which itself is bolted to the pool deck.

The stanchion 50 fits into a stanchion receiver 52 of appropriate matching diameter formed integrally with the underside of the slide runway. Placement of the stanchion receiver is at the approximate center of gravity of the slide and user when the user reaches the lowest point of the runway. For a 3 foot slide with a 90° curve and elevated exit lip, the center of gravity is about 17 inches from the exit lip and 4 inches to the convex side of the runway center line. The exit portion of the runway is cantilevered from the support stanchion.

Figure 5:
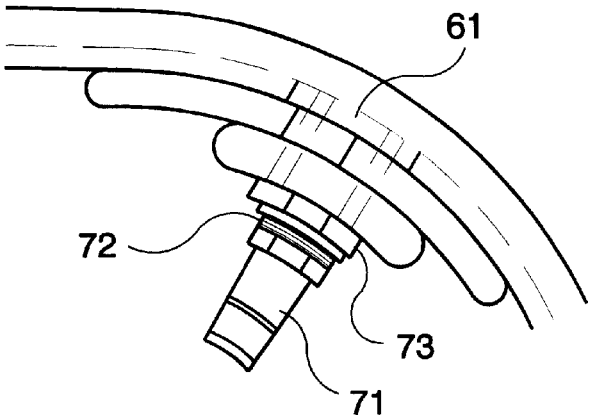
FIG. 5 is a detailed view of the water distribution system inlet fitting of the current invention.
Figure 6:
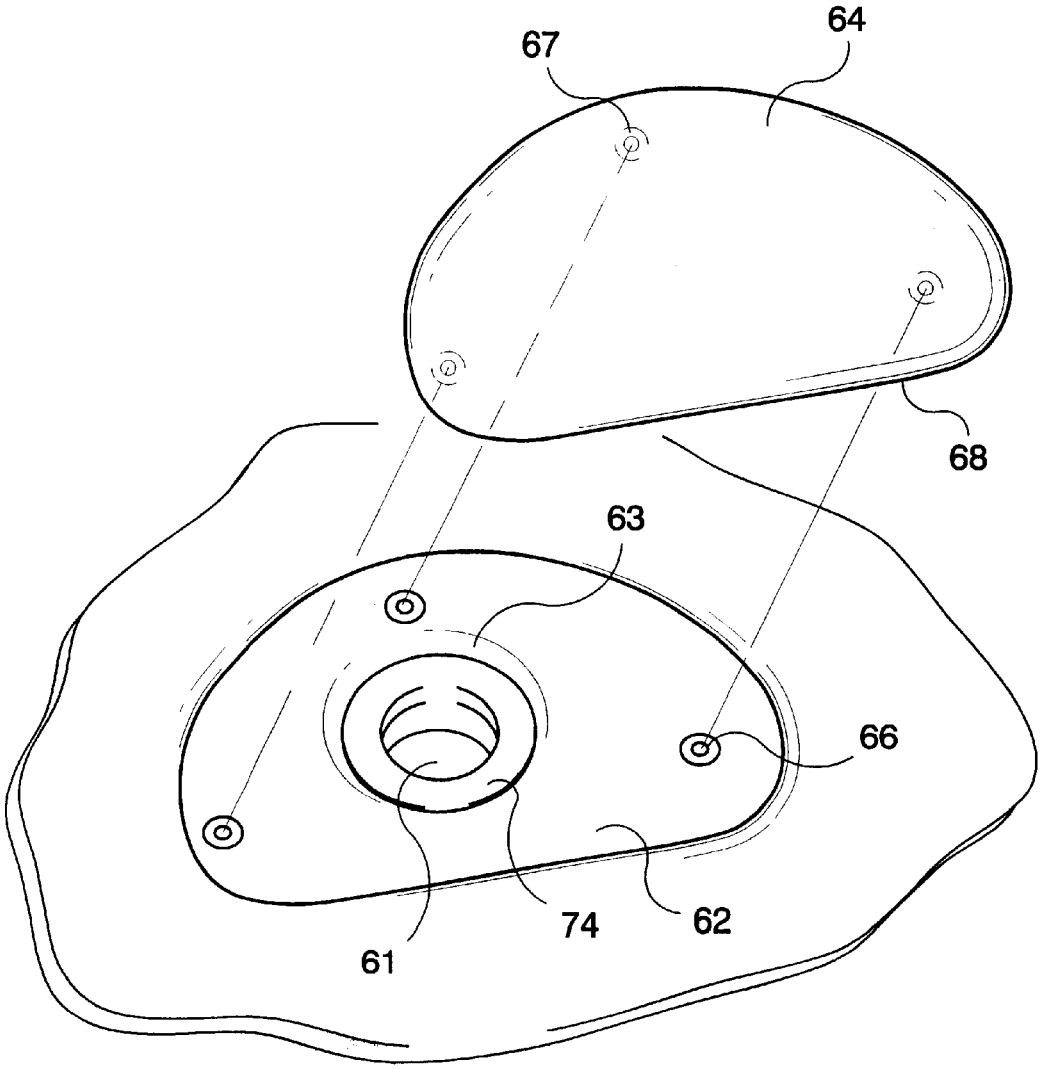
FIG. 6 is a detail of the water distribution system showing the top and the cover plate.

Another feature of the invention is the lubricating water delivery system shown in FIGS. 5 and 6. A water input aperture 61 is located on the underside of the slide body. In one embodiment, an inlet fitting 71 is a 1½ inch tube, as contrasted with the ¼ inch hose commonly used to supply water to slides. The inlet fitting has a threaded end 72 onto which a lower attachment collar 73 and an upper attachment collar 74 are threaded, with the slide runway firmly sandwiched between the collars. A shallow diffusing cavity 62 is formed in the runway surface during manufacture, and includes a well 63 leading to the input aperture 61 and sized to accept the upper attachment collar 74. The diffusing cavity 62 is elongated transversely to cross most of the trough of the slide, and is indented to accept a cover. A diffuser cover 64 fits into the cavity 62 and forms a surface flush with the runway surface. Attachment bolts or lugs 65 may be inserted through holes 66 in the diffuser cavity and holes 67 in the cover, or other attachment means may be used. The downward facing edge 68 of the diffuser cover 64 is not sealed against the cavity, so water from the inlet flows into the cavity and past the diffuser cover through the gap between the cover and the cavity. The effect is a high-volume flow of water distributed across and then down the trough of the slide, affording heightened anti-friction lubrication for users and a faster ride.

Although the invention has been described with respect to a specific embodiment, persons of ordinary skill in the art will readily understand that the inventive concepts may be applied to a variety of configurations including, without limitation, variations in the height and curvature of the slide.

I claim:

1. A swimming pool slide comprising:

a unitary slide body including a platform portion and a runway portion;

a ladder comprising a pair of ladder rails and a plurality of steps;

said ladder rails having upper portions bent to form horizontal platform supports;

a plurality of hand rails attached on top of the platform; and means for fixedly attaching the platform supports, the slide platform portion and the hand rails to form an integral construction.

2. The slide of claim 1 wherein the runway portion is curved so that an exit end of the runway is not parallel to the platform.

3. The slide of claim 1 wherein the runway portion is curved through an arc of about 90° so that the orientation of an exit end of the runway is approximately perpendicular to the orientation of the platform.

4. The slide of claim 3 further including a runway side rail on each side of the runway, with the side rail on the outside of the curve transitionally increased in height to about twice the height of the opposing side rail at a portion of the slide having maximum curvature so as to form a banked turn surface for a user.

5. The slide of claim 4 further including a central front cantilever support stanchion comprising a base plate, a tubular support member fitted in the base plate, and a support member receiver integral with an underside portion of the slide.

6. The slide of claim 5 wherein the exit end of the runway is slightly elevated above a lowest point in the runway surface.

7. The slide of claim 5 further including a water distribution comprising an inlet aperture in an upper portion of the runway, a shallow diffusing cavity in the runway contiguous to the inlet aperture, which cavity extends substantially across the runway; and a diffuser cover that fits over the cavity and allows water in the cavity to spread across the runway and escape downward along the runway.

8. A swimming pool slide comprising a ladder and a slide body including a platform portion;

a runway portion having a curve through an arc of about 90° so that the orientation of an exit end of the runway is approximately perpendicular to the orientation of the platform;

a runway side rail on each side of the runway, with the side rail on the outside of the curve transitionally increased in height to about twice the height of the opposing side rail at a portion of the slide having maximum curvature so as to form a banked turn surface for a user; and a central front cantilever support stanchion comprising a base plate, a tubular support member fitted in the base plate, and a support member receiver integral with an underside portion of the slide.

9. The slide of claim 8 wherein the exit end of the runway is slightly elevated above a lowest point in the runway surface.

10. The slide of claim 9 further including a water distribution system comprising an inlet aperture in an upper portion of the runway, a shallow diffusing cavity in the runway contiguous to the inlet aperture, which cavity extends substantially across the runway; and a diffuser cover that fits over the cavity and allows water in the cavity to spread across the runway and escape downward along the runway.

* * * * *